US008824717B2

(12) United States Patent
Adams

(10) Patent No.: US 8,824,717 B2
(45) **Date of Patent: *Sep. 2, 2014**

(54) MULTIPLE APERTURE DIFFRACTION DEVICE

(75) Inventor: Michael Adams, Vista, CA (US)

(73) Assignee: QSC Holdings, Inc., Costa Mesa, CA (US)

( * ) Notice: Subject to any disclaimer, the term of this patent is extended or adjusted under 35 U.S.C. 154(b) by 15 days.

This patent is subject to a terminal disclaimer.

(21) Appl. No.: 13/104,825

(22) Filed: May 10, 2011

(65) Prior Publication Data

US 2011/0211720 A1 Sep. 1, 2011

Related U.S. Application Data

(63) Continuation of application No. 11/674,458, filed on Feb. 13, 2007, now Pat. No. 7,953,238, which is a continuation of application No. 10/274,627, filed on Oct. 18, 2002, now Pat. No. 7,177,437.

(60) Provisional application No. 60/345,279, filed on Oct. 19, 2001.

(51) Int. Cl.
*H04R 25/00* (2006.01)

(52) U.S. Cl.
USPC ..... 381/340; 381/337; 381/339

(58) Field of Classification Search
CPC ..... H04R 25/00; H04R 1/00; H04R 1/02; H04R 1/28; H04R 1/30; H04R 1/025; H04R 1/026; H04R 1/2861; H04R 1/2865; H04R 9/06; H04R 2201/34; H04R 2201/401; H04R 2201/405; H04R 2205/022
USPC ..... 381/335–343, 351, 386, 182, 186; 181/144, 148, 152, 159, 160, 199
See application file for complete search history.

(56) References Cited

U.S. PATENT DOCUMENTS 2,001,089 A 5/1935 Blattner
2,135,610 A 11/1938 Wente (Continued)

FOREIGN PATENT DOCUMENTS

CN 2254257 5/1997
DE 968490 2/1958

(Continued)

OTHER PUBLICATIONS

Y-Axis Technical Brochure, "Line Array Elements, etc.", Adamson, 6 pages.

(Continued)

*Primary Examiner* — Suhan Ni
(74) *Attorney, Agent, or Firm* — Knobbe, Martens, Olson & Bear LLP

(57) ABSTRACT

A horn assembly for high frequency acoustic speakers. In an array of speakers, a spacing between adjacent speakers needs to be less than the wavelength of sound being emitted in order to combine effectively. For high frequency sound, a relatively small wavelength imposes a limitation on such a spacing. Such limitations are sometimes physically difficult to implement. A horn assembly increases the exit dimensions of the small speaker to larger desired dimensions by utilizing one or more plugs that divide a larger horn cavity into smaller horn cavities and creating similar pathlengths thereto. The similar pathlengths and the smaller horn cavities having desired dimensions allow the exiting sound to combine effectively. The overall dimensions of the exit portion of the horn assembly can be selected to match the dimensions of larger bass speakers, thus allowing improved arraying of the high frequency speakers with respect to other larger speakers.

17 Claims, 9 Drawing Sheets

(56) References Cited

U.S. PATENT DOCUMENTS

| | | | | |
|---|---|---|---|---|
| 2,203,875 | A | 6/1940 | Olson | |
| 2,537,141 | A | 1/1951 | Klipsch | |
| 3,852,529 | A | 12/1974 | Schafft | |
| 3,972,385 | A | 8/1976 | Hino et al. | |
| 4,040,503 | A | 8/1977 | Hino et al. | |
| 4,071,112 | A | 1/1978 | Keele, Jr. | |
| 4,210,223 | A | 7/1980 | Gillum et al. | |
| 4,325,456 | A | 4/1982 | Ureda | |
| 4,344,504 | A | 8/1982 | Howze | |
| 4,390,078 | A | 6/1983 | Howze et al. | |
| 4,685,532 | A | 8/1987 | Gunness | |
| 4,718,517 | A | 1/1988 | Carlson | |
| 4,776,428 | A | 10/1988 | Belisle | |
| 4,836,327 | A * | 6/1989 | Andrews et al. | 381/341 |
| 4,893,343 | A | 1/1990 | Bader | |
| 4,975,965 | A | 12/1990 | Adamson | |
| 5,117,462 | A | 5/1992 | Bie | |
| 5,163,167 | A | 11/1992 | Heil | |
| 5,351,220 | A | 9/1994 | Noselli | |
| 5,524,062 | A | 6/1996 | Oh | |
| 5,900,593 | A | 5/1999 | Adamson | |
| 5,970,158 | A | 10/1999 | Beltran | |
| 6,112,847 | A | 9/2000 | Lehman | |
| 6,343,133 | B1 * | 1/2002 | Adamson | 381/340 |
| 6,394,223 | B1 | 5/2002 | Lehman | |
| 6,530,451 | B2 | 3/2003 | Noselli | |
| 6,581,719 | B2 | 6/2003 | Adamson | |
| 6,628,796 | B2 | 9/2003 | Adamson | |
| 6,668,969 | B2 | 12/2003 | Meyer et al. | |
| 6,744,899 | B1 | 6/2004 | Grunberg | |
| 7,177,437 | B1 | 2/2007 | Adams | |
| 7,278,513 | B2 | 10/2007 | Brawley, Jr. | |
| 7,650,006 | B2 | 1/2010 | Isotalo | |
| 7,953,238 | B1 | 5/2011 | Adams | |
| 2001/0023792 | A1 | 9/2001 | Noselli | |
| 2002/0114482 | A1 | 8/2002 | Adamson | |
| 2003/0068058 | A1 | 4/2003 | Noselli | |
| 2003/0132056 | A1 | 7/2003 | Meyer et al. | |
| 2003/0188920 | A1 | 10/2003 | Brawley, Jr. | |
| 2004/0218773 | A1 | 11/2004 | Andrews | |
| 2007/0080019 | A1 | 4/2007 | Kubota | |
| 2008/0264717 | A1 | 10/2008 | Onishi | |
| 2011/0274306 | A1 | 11/2011 | Adams | |

FOREIGN PATENT DOCUMENTS

| | | | |
|---|---|---|---|
| GB | 327145 | | 3/1930 |
| GB | 495594 | | 11/1938 |
| GB | 1463192 | | 2/1977 |
| GB | 2316846 | | 3/1998 |
| GB | 2 458 275 | | 9/2009 |
| GR | 1003008 | B | 11/1998 |
| JP | 58130693 | A2 | 8/1983 |
| JP | 09135489 | A2 | 5/1997 |
| JP | 10-66183 | | 3/2010 |
| WO | WO 02/25991 | | 3/2002 |
| WO | WO 02/056293 | | 7/2002 |

OTHER PUBLICATIONS

Technical Specifications, Y-Axis, Adamson Systems Engineering, Inc. 2 pages; Sep. 2001.

"Line Arrays versus line Source arrays" *L'Acoustica*, Jan. 2001, pp. 1-14.

Audio Engineering Society Convention Paper, Presented at the 110$^{th}$ Convention, May 12-15, 2001, Amsterdam, The Netherlands, pp. 1-12.

John Eargle, David Scheirman and Mark Ureda, JBL's Vertical Technology™: Achieving Optimum Line Array Performance Through Predictive Analysis, Unique Acoustic Elements and a New Loudspeaker System, JBL Professional White Paper, Sep. 2000—Audio Engineering Society Convention, pp. 1-15.

"Molding Vinyl Ester Engineered Structural Composite (ESC) Molding Compounds", Quantum Composites®, Inc. Subsidiary of Premix, Inc. Reprinted from *Plastics Engineering*, Feb. 1989.

"Outline wishes to state that its "Butterfly" series line array is an original proprietary product", Outline s.n.c., Sep. 19, 2003, 25 pp.

Urban, Heil and Bauman, "Wavefront Sculpture Technology", *Acoustic Engineering Society*, Reprint #5488, 2001.

Breshears, Vance and Heinz Ralph, "An Integrated Three-Way Constant Directivity Speaker Array," presented at the 101$^{st}$ AES Convention, Los Angeles, California, Nov. 8-11, 1996.

Button, Doug, "High Frequency Components for High Output Articulated Line Arrays," Audio Engineering Society Convention Paper, presented at the 113$^{th}$ Convention, Los Angeles, California, Oct. 5-8, 2002.

Meyer Sound, "Line Arrays: Theory, Fact and Myth", Technical Paper, Copyright 2002.

Meyer Sound, "The Design and Performance of the REM Ribbon Emulation Manifold Waveguide," Technical Paper, Copyright 2005.

Urban, Marcel and Bauman, Paul, "Wavefront Sculpture Technology," *J. Audio Eng. Soc.*, vol. 51, No. 10, Oct. 2003.

* cited by examiner

MULTIPLE APERTURE DIFFRACTION DEVICE

RELATED APPLICATIONS

This application is a continuation of U.S. application Ser. No. 11/674,458 filed Feb. 13, 2007 which is a continuation of U.S. application Ser. No. 10/274,627, filed Oct. 18, 2002, (now U.S. Pat. No. 7,177,437), which claims the benefit of U.S. Provisional Application No. 60/345,279 filed Oct. 19, 2001 which are hereby incorporated in their entirety herein by reference.

BACKGROUND OF THE INVENTION

1. Field of the Invention

This invention relates to sound technology in general and, in particular, relates to a speaker having a single driver element and multiple apertures in an array.

2. Description of the Related Art

Speakers convert electrical signals to sound waves that allow listeners to enjoy amplified sounds. One of the factors that determine the quality of the speaker-generated sound heard by the listener is the sound pressure level (SPL). The quality of the SPL generally depends, among other factors, on the size of the speaker relative to the distance between the speaker and the listener. Generally, a larger distance requires a larger speaker size. Obviously, there is a practical limit on how large a speaker can be made. For example, an overly large speaker may create difficulties in transporting or mounting. Furthermore, a correspondingly large driving element needed to drive such a large speaker may require an impractical amount of power.

To circumvent such drawbacks, an array of smaller sized speakers can be used to achieve similar acoustic results. As is generally understood, sound waves from the individual smaller speakers may combine to yield a combined sound wave that behaves similar to that emanating from a single large speaker.

Effective and coherent combination of sound waves may be achieved when certain wave related parameters are satisfied. One such requirement is that the individual waves emanating from the smaller speakers need to have a substantially fixed phase difference among themselves. When all of the smaller speakers in a linear arrangement are driven substantially in phase (substantially zero phase difference), a resulting combined wave propagates in a direction normal to a line defined by the speakers. A substantially fixed non-zero phase difference among the individual waves results in a combined wave that propagates at an angle with respect to the normal direction. In typical arrayed speaker applications, the individual smaller speakers are driven substantially in phase.

Another requirement for a quality combined wave from the array of smaller speakers is that the spacing between the speakers need to have certain dimension relative to the wavelength of the sound waves. As a rule of thumb, it is generally accepted that the spacing between two neighboring speakers needs to be smaller than the wavelength of the sound wave in question. In some standards, the spacing requirement is tighter at half the wavelength. One reasons is that if the spacing is larger than the wavelength (or half the wavelength), the resulting combination of the waves suffers from poor directional properties, including unwanted side lobes of sound patterns away from the desired direction.

The wavelength of a wave is determined as wave velocity divided by wave frequency. The wave velocity of sound in room temperature air is approximately 1130 ft/sec. For an exemplary low frequency audio sound having a frequency of 200 Hz, the corresponding wavelength is approximately 68". Similarly, a midrange audio sound with a frequency of 2000 Hz, the corresponding wavelength is approximately 6.8" For the low frequency audio sound, maintaining the spacing between the speakers less than the wavelengths under the exemplary 68" is easily achieved. For the midrange audio sound, arranging the midrange speakers with spacing under the exemplary 6.8", while more challenging than that of the low frequency case, is still achievable.

For a high frequency audio sound with an exemplary frequency of 20000 Hz, the corresponding wavelength is approximately 0.68". This relatively small wavelength poses a problem for spacing of the high frequency speakers, since the components of the speaker has physical limitations on how small they can be made. For example, the magnet assembly that drives the speaker cone needs to be of certain minimum size such that positioning two such speakers adjacent to each other yields a center-to-center spacing larger than the exemplary wavelength of 0.68". Thus, the resulting high frequency sound emitted from such an array of high frequency speakers suffers from the aforementioned directionality problems.

For the foregoing reasons, there is a continuing need for an improved system and method for transmitting a sound wave from a speaker or a plurality of speakers. In particular, there is a need for transmitting high frequency sound waves in a manner that allows increasing of the dimension of the transmitted wavefronts while mitigating the undesired effects that degrade the sound quality.

SUMMARY OF THE INVENTION

The aforementioned needs are satisfied by one aspect of the invention relating to a speaker assembly comprising a sound source that produces a sound signal. The speaker assembly further comprises a housing having an input aperture and a plurality of output apertures that are aligned in a first direction. The housing is attached to the sound source so as to receive the sound signal at the input aperture. The housing defines a plurality of isolated paths having substantially equal path lengths that link the input aperture to the plurality of output apertures. The sound signal is divided into a plurality of sound signals that are distributed in the first direction by travel along the plurality of isolated paths. The plurality of sound signals emanate from the plurality of output apertures at substantially the same time so as to combine to form a substantially coherent combined sound signal that is expanded in the first direction.

In one embodiment, the housing defines the plurality of isolated paths by one or more plugs having a first end biased towards the input aperture and a second end biased towards the output aperture. The first end of a given plug divides an existing path into two isolated paths and the second end of the given plug divides an existing output aperture into two smaller output apertures. The plug has a maximum width at a location between the first and second ends such that the isolated paths formed by the plug flare open into the output apertures.

The amount of flare and the corresponding dimension of the output aperture are selected such that the curvature $\delta$ of the wavefronts emanating therefrom is less than a quarter of the wavelength of the sound signal. The curvature $\delta=(L/2)\tan(\phi/2)$ where L is the dimension of the output aperture and $\phi$ is the opening angle of the flare. In one embodiment, the plug has a diamond shape elongated along a line that joins the first and second ends.

The aforementioned needs are satisfied by another aspect of the invention relating to a speaker assembly comprising a sound source that produces a first sound signal. The speaker assembly further comprises a horn assembly that receives the first sound signal and directs the first sound signal along a plurality of paths so as to expand the first sound signal into a plurality of sound signals that are distributed in at least a first direction. The horn assembly includes a plurality of flared apertures that are aligned in the first direction such that the plurality of sound signals emanate from the plurality of flared openings so as to produce a combined substantially coherent sound signal.

In one embodiment, the plurality of paths comprise a plurality of isolated paths. In one embodiment, the horn assembly includes a housing having an output wall of a first length. The plurality of flared apertures are formed in the output wall such that each of the plurality of sound signals have a length that is less than the first length so that the overall curvature of the combined substantially coherent sound signal is reduced to thereby facilitate coherent combination with sound signals emanating from adjacent sound sources.

In one embodiment, the horn assembly housing includes an input opening that receives the first sound signal from the sound source. The housing defines the plurality of paths, and the plurality of paths emanate outward from the input opening in a pattern where the outermost paths define first angle therebetween. The plurality of flared apertures are flared at an angle which is less than or equal to the first angle. The flare angle and the corresponding length of the sound signal are selected such that the curvature $\delta$ of the sound signal emanating therefrom is less than a quarter of the wavelength of the sound signal. The curvature $\delta=(L/2)\tan(\phi/2)$ where L corresponds to the length of the sound signal and $\phi$ is the flare angle.

The plurality of paths and their corresponding flared apertures are defined by one or more plugs having a first end biased towards the sound source and a second end biased towards the flared apertures. The first end of a given plug divides an existing path into two paths and the second end of the given plug divides an existing flared aperture into two smaller flared apertures. The plug has a maximum width at a location between the first and second ends. In one embodiment, the plug has a diamond shape elongated along a line that joins the first and second ends.

The aforementioned needs are satisfied by yet another aspect of the invention relating to a speaker assembly comprising a sound source that produces a sound signal The speaker assembly further comprises a housing having a first input aperture and a first output aperture. The housing is attached to the sound source such that the first input aperture is adjacent the sound source. The first output aperture is larger than the first input aperture along at least a first direction. The speaker assembly further comprises at least one plug positioned between the first input aperture and the first output aperture so as to define two or more smaller output apertures that are smaller than the first output aperture along at least the first direction. The first input aperture and the two or more smaller output apertures are linked by isolated paths having substantially equal path lengths such that the sound signal is divided into two or more sound signals that are distributed in the first direction by travel along the two or more isolated paths. The two or more sound signals emanate from the two or more smaller output apertures at substantially the same time so as to combine to form a substantially coherent combined sound signal that is expanded in the first direction.

In one embodiment, the two or more isolated paths are flared adjacent the corresponding two or more smaller output apertures. The plug has a first end biased towards the first input aperture and a second end biased towards the first output aperture. The first end of a given plug divides an existing path into two isolated paths and the second end of the given plug divides an existing output aperture into two smaller output apertures. The plug has a maximum width at a location between the first and second ends so as to provide the flaring of the isolated paths adjacent their corresponding smaller output apertures.

The amount of flare and the corresponding dimension of the smaller output aperture along the first direction are selected such that the curvature $\delta$ of the sound signals emanating therefrom is less than a quarter of the wavelength of the sound signal. The curvature $\delta=(L/2)\tan(\phi/2)$ where L is the dimension of the smaller output aperture and $\phi$ is the opening angle of the flare. In one embodiment, the plug has a diamond shape elongated along a line that joins the first and second ends.

The aforementioned needs are satisfied by yet another aspect of the invention relating to an array of speakers comprising a plurality of low frequency speakers arranged along a first direction. The low frequency speakers have a first dimension along the first direction. The array further comprises a plurality of high frequency speakers arranged along the first direction. Each high frequency speaker comprises a driver coupled to a horn assembly having an input aperture that receives a sound signal from the driver, and a plurality of flared apertures that are aligned in the first direction. The input aperture is linked to the plurality of flared apertures by a plurality of paths that direct the sound signal therethrough so as to expand the sound signal into a plurality of sound signals that are distributed in the first direction. The plurality of sound signals emanating from the plurality of flared openings produce a substantially coherent combined sound signal.

In one embodiment, each of the plurality of flared aperture is dimensioned such that the curvature $\delta$ of the sound signals emanating therefrom is less than a quarter of the wavelength of the sound signal. The curvature $\delta=(L/2)\tan(\phi/2)$ where L is the dimension of the flared aperture and $\phi$ is the opening angle of the flare along the first direction. In one embodiment, the sum of the first direction dimension of the plurality of the flared apertures is at least 80% of the first dimension. In one embodiment, the high frequency speakers are arranged along a vertical direction. In one embodiment, each high frequency speaker further comprises a horizontal flare attached to the plurality of flared openings, thereby controlling the horizontal dispersion of the emanating sound signals.

The aforementioned needs are satisfied by yet another aspect of the invention relating to a speaker assembly comprising a sound source that produces a sound signal. The speaker assembly further comprises a housing that defines an input aperture and two or more flared horn cavities having exit apertures. Each flared horn cavity has an opening angle and each exit aperture has a length along a first direction. The input aperture is adjacent the sound source, and the exit apertures are aligned along a first direction. The input aperture is linked to the flared horn cavities by paths that are at least partially isolated from each other. The sound signal from the sound source is distributed to the flared horn cavities and exit through the exit apertures. The opening angles of the flared horn cavities and the lengths of the exit apertures are selected so as to approximate a segmented line source of sound.

In one embodiment, each of the two or more flared horn cavities is dimensioned such that the curvature $\delta$ of sound wavefronts emanating therefrom is less than a quarter of the wavelength of the sound signal. The curvature $\delta=(L/2)\tan(\phi/$ 2) where L is the length of the exit aperture and $\phi$ is the opening angle of the flared horn cavity.

DETAILED DESCRIPTION OF THE PREFERRED EMBODIMENT

Reference will now be made to the drawings wherein like numerals refer to like parts throughout. A multiple-aperture acoustic horn is an apparatus that provides multiple paths for a sound wave being emitted from a single speaker driver. The multiple paths can be advantageously configured to suit various application needs. A general operating principle is described in reference to FIGS. 1-3, and some of the various possible embodiments are described in reference to FIGS. 4-6.

Figure 1B:
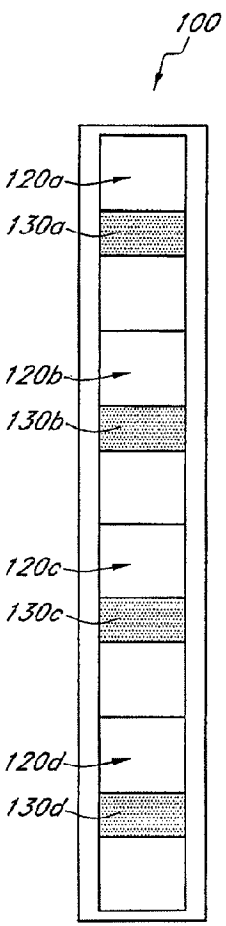
FIG. 1B illustrates a front view of the horn assembly of FIG. 1A.
Figure 1A:
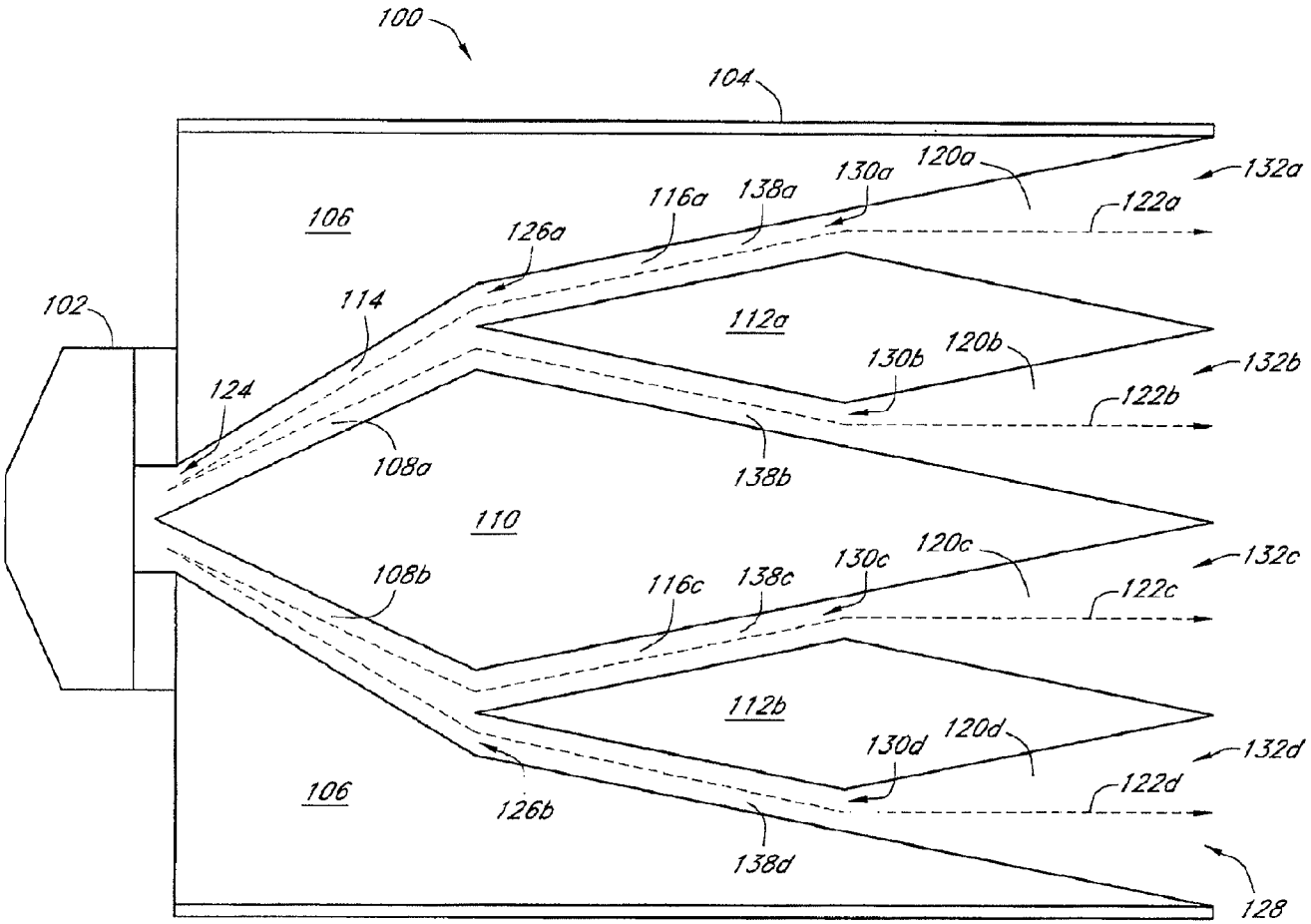
FIG. 1A illustrates a side view of one embodiment of a horn assembly that provides multiple acoustic paths to multiple exit apertures to allow expansion of a relatively small sound source to a larger dimensioned exit.

FIGS. 1A-C illustrate one possible embodiment of a multiple-aperture acoustic apparatus 100 comprising a single speaker driver 102 attached to a horn assembly 104. The horn assembly 104 comprises a first horn 106 that has a back end and a front end, and the back end defines a first input aperture 124 dimensioned to receive the sound waves being emitted by the speaker driver 102. The first input aperture 124 may be a circular aperture to mate with a circular speaker driver. Alternatively, the first input aperture 124 may have any number of shapes and dimensions to mate efficiently with any number of speaker driver shapes.

The first horn 106 also defines a first exit aperture 128 at the front end that is larger than the first input aperture 124, thereby defining a horn shaped first cavity 114. As shown in FIG. 1A, a side sectional profile of the first cavity 114 generally opens up from the first input aperture 124 to the first exit aperture 128. As shown in FIG. 1B, a frontal view of the horn assembly 104 shows that in one embodiment, the first cavity 114 has a generally rectangular shape. It will be understood, however, that various other frontal shapes of the first cavity may be utilized without departing from the spirit of the invention. Various possible dimensions and materials that can be implemented for the first horn 106 are described below.

The horn shape of the first cavity 114, in absence of other structures described below, causes sound waves being emitted from the speaker driver 102 to generally cause the wavefronts to become rounded, thereby causing the sound waves' directionality to spread out. If the speaker driver 102 pumps into the first input aperture 124 generally plane waves, the wavefronts become rounded due to the fact that wavefronts tend to be orthogonal to the boundaries. Thus, the degree of rounding of the wavefronts generally depend on the taper angle of the horn.

As is described below, two or more horn assemblies may be stacked vertically. The manner in which the sound waves from such horn assemblies combine depends on factors such as the frequency of the sound waves, dimension of the exit aperture, and the pitch of the taper. In audio applications, a generally accepted rule is that a curvature (defined below) of the rounded wavefront needs to be less than approximately ¼ of the wavelength $\lambda$ of the sound wave. One possible method determining the wavefront curvature is disclosed in an Acoustic Engineering Society convention paper titled "Line Arrays: Theory and Applications", authored by Mark S. Ureda and presented in May, 2001. The derivation of the wavefront curvature in the Ureda paper is in context of segmented line sources, but the general principle also holds in context of the horn shaped source.

Figure 2:
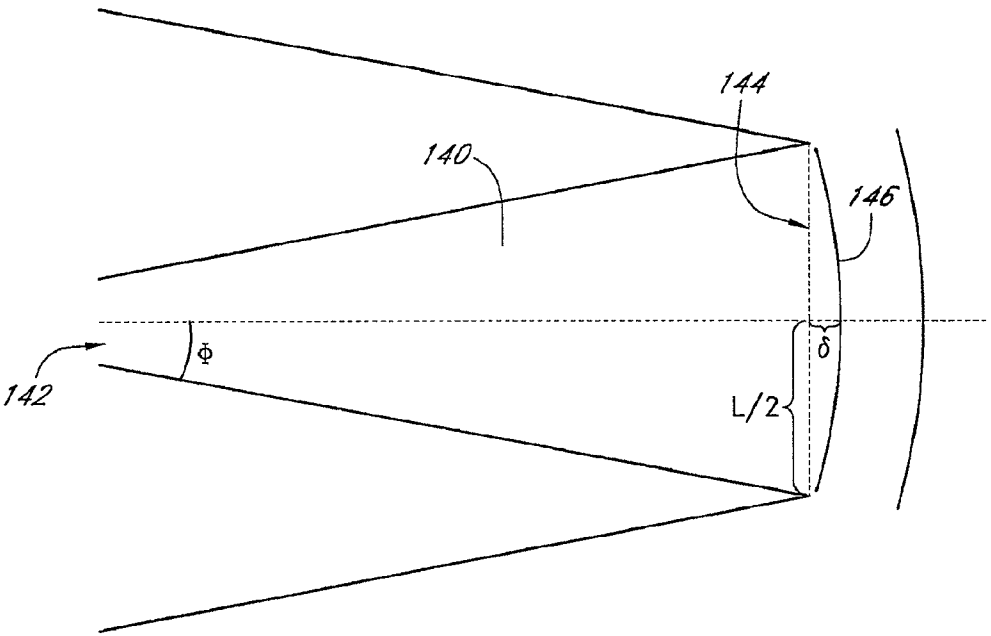
FIG. 2 illustrates a horn cavity geometry and its effects on the emitted sound wave.

FIG. 2 illustrates a generic horn shaped cavity and some corresponding geometry related parameters to put the wavefront curvature parameter in a proper context. A horn cavity 140 defined by flanking structures has an input aperture 142 and an exit aperture 144. The exit aperture 144 has a dimension of L along a direction perpendicular to a center axis). The horn cavity 140 tapers in a opening manner from the input aperture 142 to the exit aperture 144 at an opening angle of $\phi$ (angle between the center axis and one tapered side). As previously described, a wavefront propagating through such a tapered cavity becomes rounded. Thus, as a wavefront 146 exits the exit aperture 144, a distance from the face of the exit aperture 144 and the wavefront 146 along the center axis is defined as a wavefront curvature $\delta$. As derived in the Ureda paper, the curvature $\delta$ may be expressed as $$\delta = \left(\frac{L}{2}\right)\tan\left(\frac{\phi}{2}\right). \tag{1}$$

As seen in Equation 1, the curvature $\delta$ is proportional to the dimension L of exit aperture, and also increases with the opening angle $\phi$ within the range of 0 to 45 degrees. Thus, the parameters L and/or $\phi$ determine the limit on the effectively combinable wavelength (i.e., $\delta<\frac{1}{4}\lambda$) of the signals emitted from the horn cavity 140.

Based on the rule $\delta<\frac{1}{4}\lambda$, a minimum wavelength of effectively combinable sound wave can be expressed as $$\lambda_{min}=4\delta. \tag{2}$$

Alternatively, since frequency of sound is a more common parameter used in audio industry, and since frequency and wavelength is related in a simple inverse relationship, Equation 2 can be expressed as $$f_{max} = \frac{c}{4\delta}, \tag{3}$$

where c is the speed of sound and the curvature δ is determined from Equation 1. Thus, the geometry dependent parameters L and/or ϕ determine the maximum effectively combinable sound wave being emitted from a horn cavity. It will be understood that the frequency limit $f_{max}$ relates to the effective combining of the sound waves emanating from two or more horn cavities arranged in a linear array to approximate a segmented line source, and not necessarily to the sound quality of the individual horn cavity by itself.

In certain audio applications, it may be desirable to have the dimension L of the exit aperture conform to some selected value. For example, an ensemble of various speakers may form a plurality of vertical arrays, where each vertical array comprises either low frequency, mid-range, or high-frequency speakers (or horns extending therefrom). In one such configuration, a vertical stack of high-frequency speaker assemblies (speaker assembly comprising speaker driver and horn assembly, for example) may be interposed between two vertical stacks of bass speakers. For various reasons, it may be desirable to have the vertical dimension of the exit aperture of the high-frequency speaker assembly be similar to that of the bass speaker. One difficulty encountered in such a design is that bass speakers are generally relatively large, thus the corresponding value of L partially determines the upper frequency limit of the high-frequency speaker assembly. For example, if L is approximately 9" (being positioned next to a 9" diameter bass speaker) and the opening angle ϕ is approximately 10 degrees, then the curvature δ is approximately 0.4", and the upper frequency limit $f_{max}$ is approximately 8.6 KHz which is substantially below what is considered a high-frequency audio range. Thus while such a horn may function well by itself as a high frequency component, an array of such horns yields a degraded quality combined sound wave when the frequency exceeds the exemplary $f_{max}$ of 8.6 KHz.

In one aspect of the invention, various embodiments of horn assemblies comprise one or more wave dividing structure referred hereinafter as a "plug". A plug, positioned in the horn cavity, is shaped so as to define additional smaller exit apertures, and also provide different paths for the sound waves from the input aperture to the smaller exit apertures. Thus, a given plug defines a new set of exit apertures, each having a smaller dimension than the original dimension L. As described below in greater detail, each of the exit apertures advantageously has dimensions and opening angle that yield a higher value for the frequency limit $f_{max}$.

Referring to FIG. 1A, the horn assembly 104 comprises a first plug 110 positioned within the first horn cavity 114, thereby defining, along with the first horn 106, second horn cavities 116*a, b* having second input apertures 126*a, b* and second exit apertures 118*a, b*. Furthermore, the first plug 110 and the first horn 106 define first conduits 108*a* and 108*b* that respectively connect the first input aperture 124 to the second input apertures 126*a* and 126*b*. Thus, the sound wave originating from the first input aperture is split into two waves by the first plug 110, and the two waves travel through their respective first conduits 108*a, b*, through the second input apertures 126*a, b*, and into the second horn cavities 116*a, b*.

Preferably, the first plug 110 is dimensioned and positioned so as to be symmetric with respect to the axis of the first horn 106. Then, each of the second exit apertures 118*a, b* has a vertical dimension that is approximately half of the vertical dimension of the first aperture 128. Thus, for the aforementioned example where overall L=9" and ϕ=10 degrees, each of the newly formed two smaller horn cavities have l=L/2 and ϕ=10 degrees, thereby yielding $f_{max}$ of approximately 17 KHz (Equations 1-3). Such configuration of the horn assembly may be utilized for mid-range sound application if desired, or the exit apertures may be divided further, as described below, to achieve higher $f_{max}$.

As illustrated in FIG. 1A, the horn assembly 104 further comprises second plugs 112*a* and 112*b* positioned respectively within the second horn cavities 116*a* and 116*b*, thereby defining, along with the first horn 106 and the first plug 110, third horn cavities 120*a-d* having third input apertures 130*a-d* and third exit apertures 132*a-d*. Furthermore, the second plugs 112*a, b*, the first plug 110 and the first horn 106 define second conduits 138*a-d* that respectively connect the second input apertures 126*a, b* to the third input apertures 130*a-d*. Thus, the two sound waves passing through the second input apertures 126*a, b* are split into four waves by the second plugs 112*a, b*, and the four waves travel through their respective second conduits 138*a-d*, through the third input apertures 130*a-d*, and into the third horn cavities 120*a-d*.

Preferably, the second plugs 112*a, b* are dimensioned and positioned so as to be symmetric with respect to the axes of their respective second horn cavities 116*a, b*. Then, each of the third exit apertures 132*a-d* has a vertical dimension that is approximately quarter of the vertical dimension of the first aperture 128. Thus, for the aforementioned example where the overall L=9" and ϕ=10 degrees, each of the newly formed four smaller horn cavities have l=L/4 and ϕ=10 degrees, thereby yielding $f_{max}$ of approximately 34 KHz (Equations 1-3) which is well above the audio high-frequency range. Such configuration of the horn assembly may be utilized for high-frequency sound application.

It will be appreciated that additional plugs may be incorporated in a manner similar to that described above to yield, for example, eight smaller exit apertures. While such a configuration is not necessary for the exemplary horn assembly with L=9" and ϕ=10 degrees, other larger sized horn assemblies may benefit from having eight or more smaller exit apertures. Furthermore, as the dimension L is divided with introduction of plug(s), the opening angles of the resulting horns may have opening angles different than that of their parent horn to achieve the desired result. For example, in the exemplary original configuration of L=9" and ϕ=10 degrees, the plug(s) may be configured such that the resulting smaller horns have different opening angles (than 10 degrees—for example, greater than 10 degrees) while achieving the desired value for $f_{max}$.

As previously described, the plugs are shaped and positioned so as to be symmetric with respect to their respective horn cavities. As illustrated in FIG. 1A, such symmetry results in different sound paths 122*a-d* having a substantially similar pathlength. Thus, the sound waves travelling via the sound paths 122*a-d* and exiting the exit apertures 132*a-d* are in phase with each other, and with other similar waves from other similar and stacked horn assemblies, thereby allowing substantially coherent combination of the waves.

The plugs described above in reference to FIG. 1 have a side cross sectional shape of a diamond to fit within the straight walled horn cavities (again, in cross sectional view). The diamond shape has a first pointed end proximate its corresponding input aperture, thereby allowing efficient splitting of the sound wave into two symmetric pathways. The diamond shape also has a second pointed end opposite from the first pointed end, thereby allowing a minimum vertical gap between adjacent exit apertures.

In other embodiments, the horn cavity is not straight walled. A flared horn cavity is one such example. As described below in greater detail, a plug for such a cavity may have some curvatures on its "facets" to accommodate the flare. Thus it will be appreciated that the plug performing the aforementioned function may have different shapes and sizes without departing from the spirit of the invention.

Figure 3:
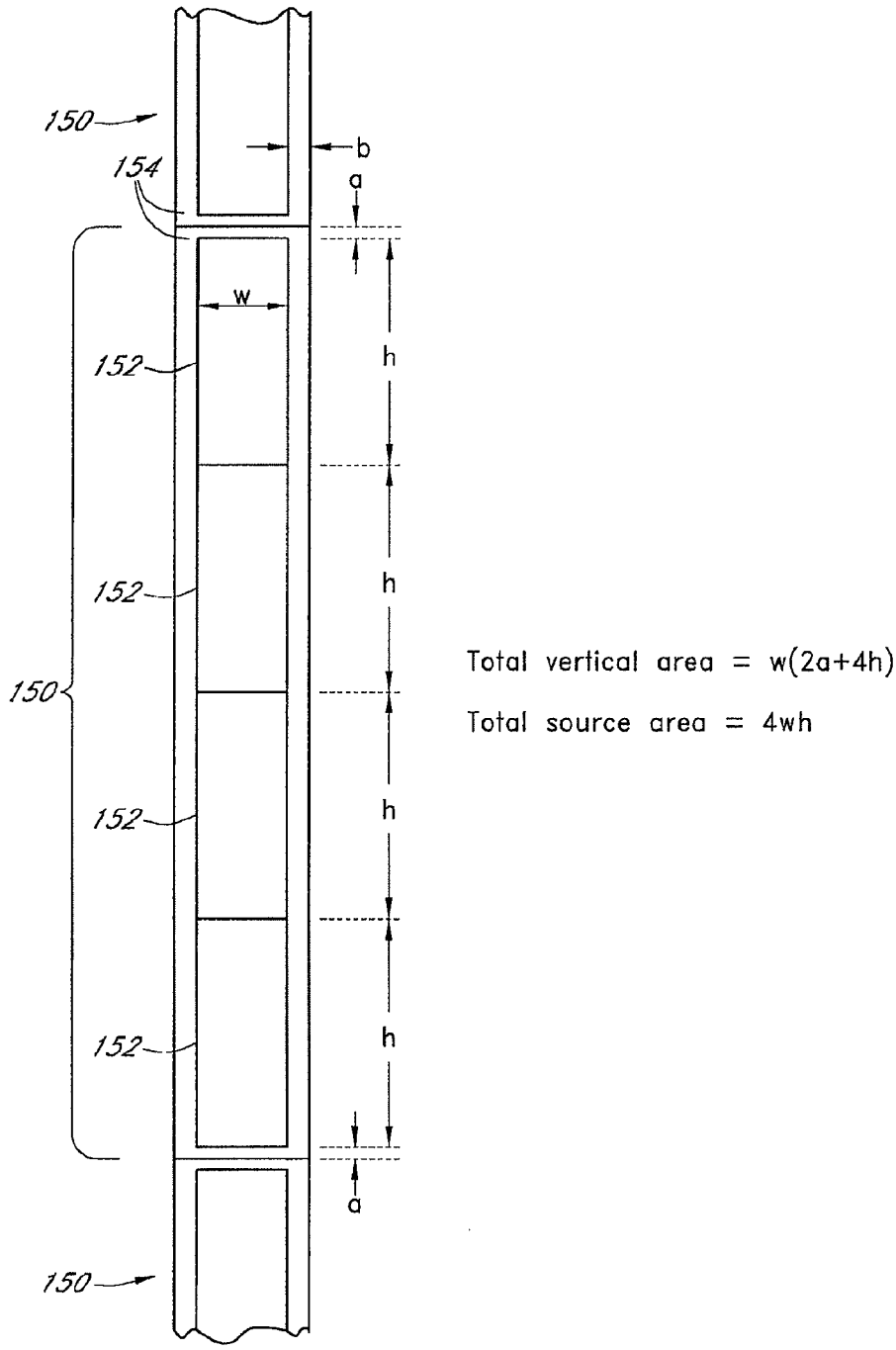
FIG. 3 illustrates an array of horn cavities stacked vertically.

FIG. 3 now illustrates a stack of horn assemblies and the associated geometry parameters that affect how well the sound waves combine. As referred to in the "Description of the Related Art" section, the spacing between adjacent sound sources relative to the wavelength affects the how effectively the waves combine. In FIG. 3, a plurality of exit apertures 152 can be considered to be the sound sources. The source-to-source (center-to-center) distance is h, which, for the exemplary 9" horn assembly with four exit apertures, is approximately 2.25"—substantially greater than the 0.68" source spacing (for the 20 KHz sound) referred to in Related Art section. It should be understood that the exemplary 0.68" spacing is for a circular wavefront (isotropic) being emitted from the source (a point source, for example). As described above, the sound wave emerging from the horn exit aperture is made to behave like a finite length line source, thereby allowing the substantial increase in the workable vertical dimension of the source Despite the fact that the vertical dimension of the source, and hence the center-center spacing of the sources can be increased substantially by the apparatus described herein, it is nevertheless advantageous to minimize gaps between the adjacent exit apertures. One reason is that the combining effects of the curved wavefronts degrade at greater distances.

The exit apertures described above in reference to FIGS. 1 and 3 are defined by the pointed (side view; an edge in front view) second ends of the diamond shaped plugs. Thus, gaps between the exit apertures within the same horn assembly is minimal. However, as shown in FIG. 3, a horn assembly 150 may comprise an outer housing 154 such that when stacked with another horn assembly 150, the housings 154 may form a gap between the two end exit apertures. In FIG. 3, this vertical gap is depicted as being 2a in dimension. One possible method of quantifying the acceptable limit on the gap is disclosed in the Acoustic Engineering Society Preprint #5488 titled "Wavefront Sculpture Technology", authored by Urban, Heil, and Bauman in 2001, where a ratio of the total source area to the total "vertical" area of 80% or greater is considered to be acceptable. The vertical area is simply a portion of the total area of the front face that is covered if the source (horn apertures in this case) extends vertically. Thus, the vertical area would not include the area covered by the side walls with thickness of b.

As shown in FIG. 3, the total vertical area of the horn assembly 150 is w(2a+4h), while the total source area is 4wh. In one embodiment, the horn exit aperture has a height h of approximately 2.25", and a width w of approximately 1". Furthermore, the top and bottom housing thickness a is approximately ⅛". Thus, the total source area is approximately 9 square inches and the total vertical area is approximately 9.25 square inches, yielding a ratio of approximately 97%, well above the acceptable limit.

Figure 4A:
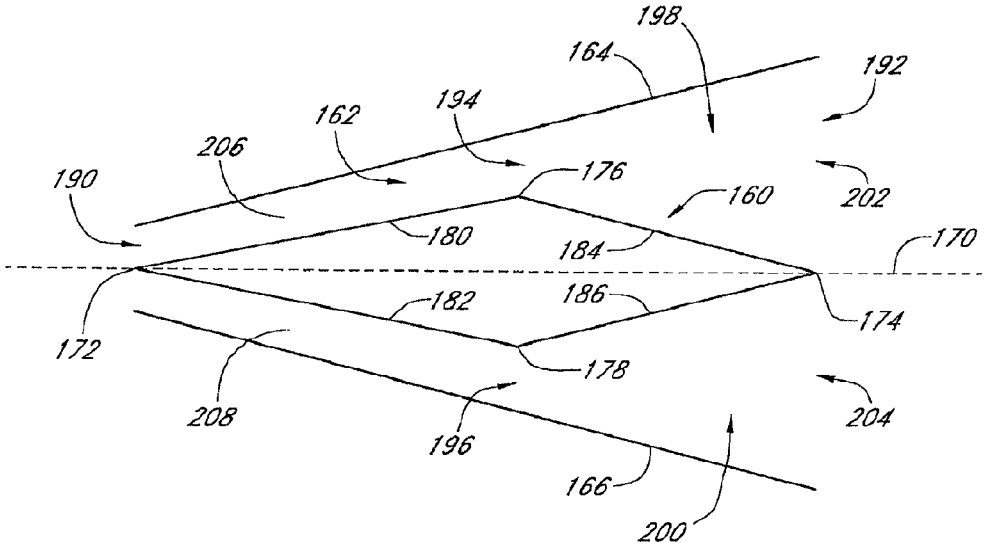
FIGS. 4A and B illustrate some possible embodiments of a plug that is positioned within a larger horn cavity to produce two smaller horn cavities, thereby allowing desirable horn geometry to be obtained for effective combining of the emitted sound waves.
Figure 4B:
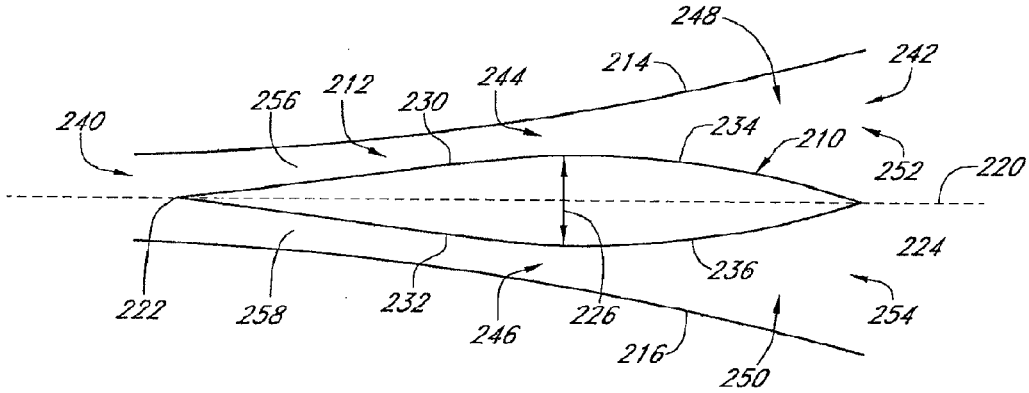

FIGS. 4A-B now illustrate some common properties of the plugs described above in reference to FIG. 1A, and those of other various embodiments described below. FIG. 4A illustrates a straight walled horn cavity 162 defined by first and second boundaries 164 and 166 that opens up from an input aperture 190 to an exit aperture 192. Such boundaries may be part of a main horn (106 in FIG. 1A, for example) or part of a larger plug. A plug 160 is positioned within the cavity 162 in a generally symmetric manner such that a longitudinal axis 170 of the plug 160 generally coincides with a longitudinal axis of the horn cavity 162.

In one embodiment, the plug 160 in side vertical cross section has a diamond shape, with a first end 172 and a second end 174 positioned along the longitudinal axis 170. The diamond shaped plug 160 further comprises side vertices 176 and 178 that form the widest lateral dimension of the plug 160 between the first and second ends 172, 174. The first end 172 and the side vertices 176, 178 are joined by interior edges 180, 182, respectively. In a similar manner, the side vertices 176, 178 and the second end 174 are joined by exterior edges 184, 186, respectively. The interior edges 180, 182 and the boundaries 164, 166 define conduits 206, 208, respectively, from a location proximate the input aperture 190 to a location proximate the side vertices 176, 178. The exterior edges 184, 186 and the boundaries 164, 166 define, respectively, two new horn cavities 198 and 200 having input apertures 194, 196 defined by the boundaries 164, 166 and the side vertices 176, 178, and exit apertures 202, 204 defined by the boundaries 164, 166 and the second end 174 of the plug 160.

It will be appreciated that the shape of the diamond plug 160 as described above in reference to FIG. 4A can be varied in any number of ways to obtain any number of desired configuration of the plug 160 with respect to the horn cavity 162. For example, the lateral dimension of the plug 160 at the side vertices 176, 178 can be increased or decreased to increase or decrease the dimensions of the conduits 206, 208 and the input apertures 194, 196. Furthermore, the longitudinal location of the side vertices 176, 178 can also be varies to alter the general shape of the horn cavities 198, 200. In one particular embodiment, the horn cavities created by the plug have a similar but scaled down horn profile as that of the original horn cavity. It will be appreciated, however, that the scaled down horn profiles do not have to have a similar profile as the original profile.

FIG. 4B illustrates another embodiment of a horn cavity, a flared horn cavity 212 defined by first and second curved boundaries 214 and 216 that opens up from an input aperture 240 to an exit aperture 242. Such boundaries may be part of a main horn or part of a larger plug. A plug 210 is positioned within the cavity 212 in a generally symmetric manner such that a longitudinal axis 220 of the plug 210 generally coincides with a longitudinal axis of the horn cavity 212.

In one embodiment, the plug 210 in side vertical cross section has an at least partially curved double ended spear shape, with a first end 222 and a second end 224 positioned along the longitudinal axis 220. The plug 210 further comprises widest lateral dimension location, indicated by a double ended arrow 226, somewhere between the first and second ends 222, 224. The first end 222 and both sides of the laterally widest location 226 are joined by interior edges 230, 232, respectively. In a similar manner, both sides of the laterally widest location 226 and the second end 224 are joined by exterior edges 234, 236, respectively. The interior edges 230, 232 and the boundaries 214, 216 define conduits 256, 258, respectively, from a location proximate the input aperture 240 to a location proximate the laterally widest location 226. The exterior edges 234, 236 and the boundaries 214, 216 define, respectively, two new horn cavities 248 and 250 having input apertures 244, 246 defined by the boundaries 214, 216 and the laterally widest location 226, and exit apertures 252, 254 defined by the boundaries 214, 216 and the second end 224 of the plug 210.

It will be appreciated that the shape of the at least curved plug 210 as described above in reference to FIG. 4B can be varied in any number of ways to obtain any number of desired configuration of the plug 210 with respect to the horn cavity 212. For example, the lateral dimension of the plug 210 at the laterally widest location 226 can be increased or decreased to increase or decrease the dimensions of the conduits 256, 258 and the input apertures 244, 246. Furthermore, the longitudinal location of the laterally widest location 226 can also be varies to alter the general shape of the horn cavities 248, 250. In one particular embodiment, the horn cavities created by the plug have a similar but scaled down horn profile as that of the original horn cavity. It will be appreciated, however, that the scaled down horn profiles do not have to have a similar profile as the original profile.

Figure 5A:
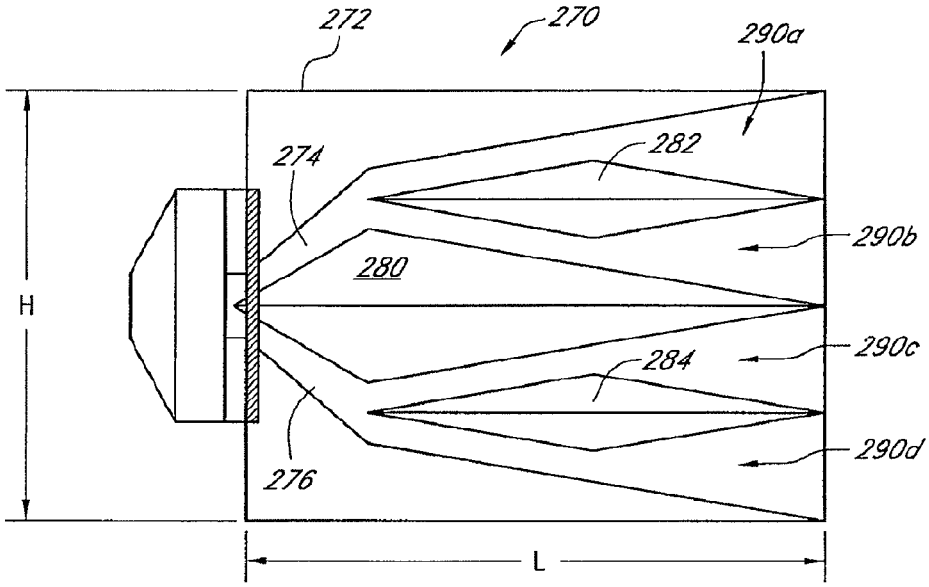
FIGS. 5A and B illustrate some possible embodiments of the horn assembly where the plugs are diamond shaped to yield straight walled horn cavities.
Figure 5B:
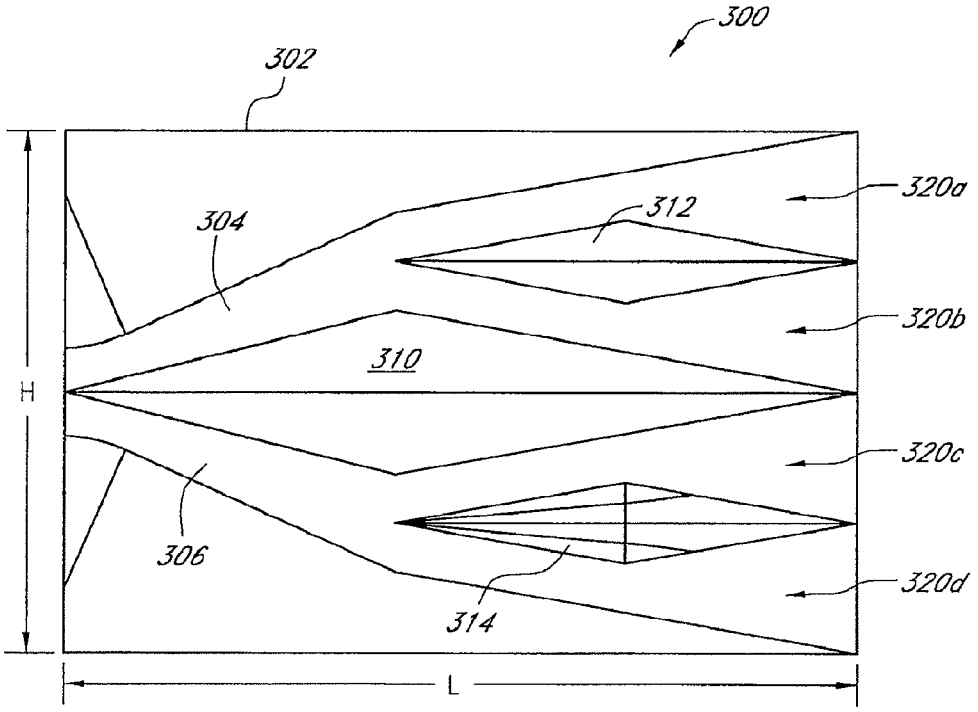
FIG. 5C illustrates one possible embodiment of the horn assembly where the plug has a curved profile to accommodate flared wall horn cavities.
Figure 5C:
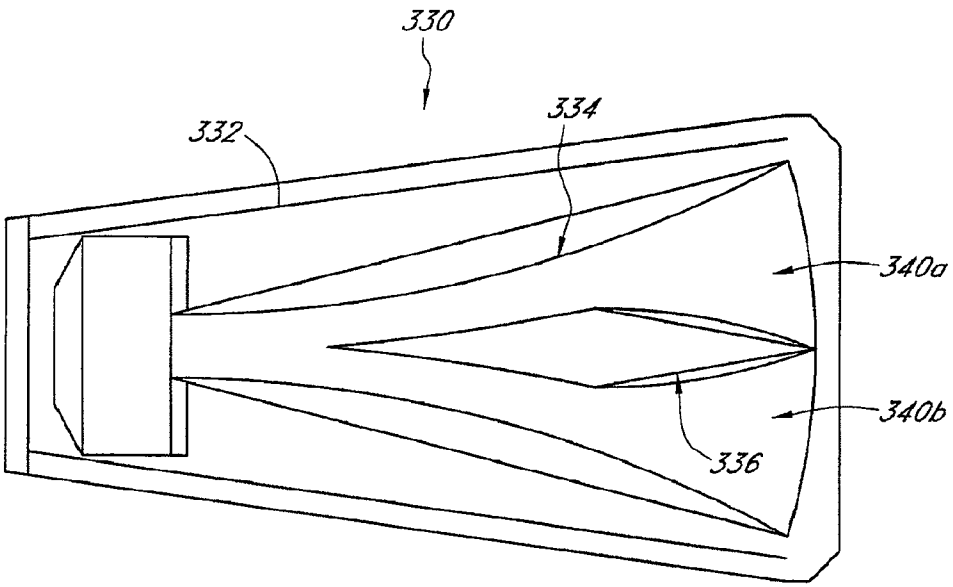

FIGS. 5A-C illustrate some possible embodiments of the horn assembly described above. In one embodiment, a horn assembly 270 comprises a plug 280 positioned with a cavity defined by a first horn 272. An interior portion of the plug 280 and the cavity define first conduits 274 and 276. An exterior portion of the plug 280 and the cavity define two smaller secondary cavities in which secondary plugs 282, 284 are positioned, thereby creating front end cavities 290*a-d*.

As seen in FIG. 5A, the plug 280 and its corresponding cavity wall are dimensioned such that the conduits 274, 276 are directed at an angle that is larger than the opening angle of the end cavities 290*a-d*. This feature is achieved by the plug 280 having side vertices positioned towards the interior portion of the cavity. In one embodiment, the horn assembly 270 has exterior dimensions of approximately 12" (L)×9" (H).

FIG. 5B illustrates another embodiment, a similar horn assembly 300 having a plug 310 positioned within a cavity defined by a first horn 302. The plug 310 has side vertices that are located more towards its center (than that of the plug 280 in FIG. 5A), such that resulting conduits 304, 306 are oriented at a smaller angle than the angle of the conduits 274, 276 described above. In one embodiment, the horn assembly 300 has exterior dimensions of approximately 12.5" (L)×8.2" (H).

FIG. 5C illustrates yet embodiment, a flared horn assembly 330 having a first horn 332 that defines a flaring cavity 334. Positioned within the cavity 334 is a horn 336 that yields two end horn cavities 340*a, b* in a manner described above in reference to FIG. 4B.

The exemplary profiles of the cavities and their corresponding plugs, described above in reference to FIGS. 5A-C, show that the configuration horn assembly can be varied in a number of ways to accommodate the desired dimension. Similarly, the configuration can be varied to allow sound quality tuning to suit various applications.

Figure 6A:
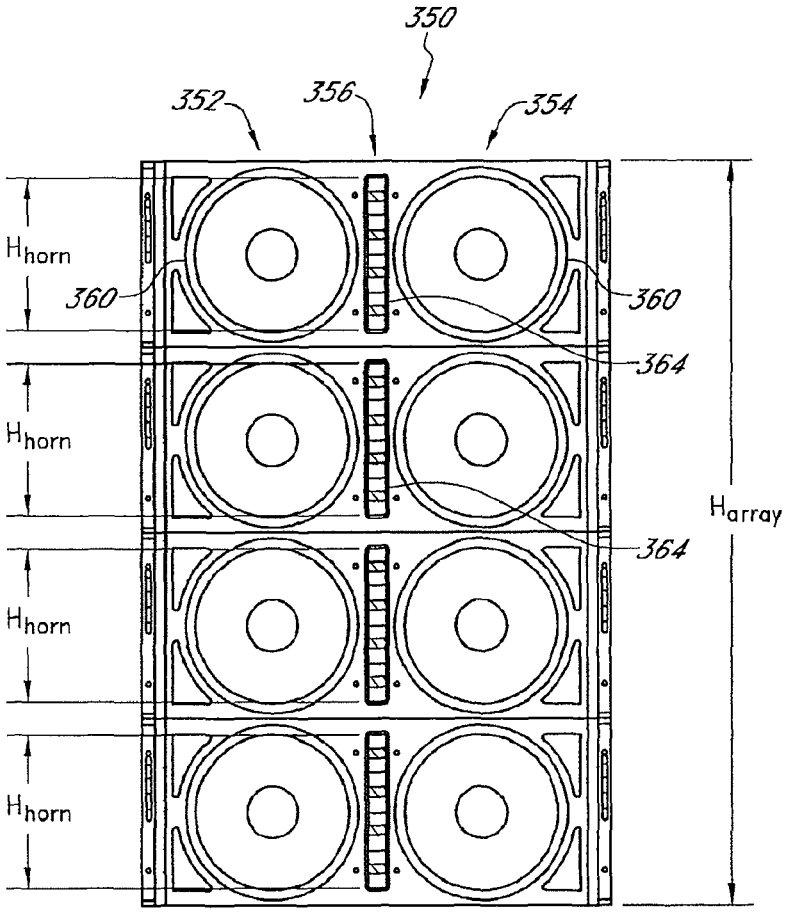
FIGS. 6A and B illustrate some possible methods of arraying the enlarged exits provided by various embodiments of the horn assembly.
Figure 6B:
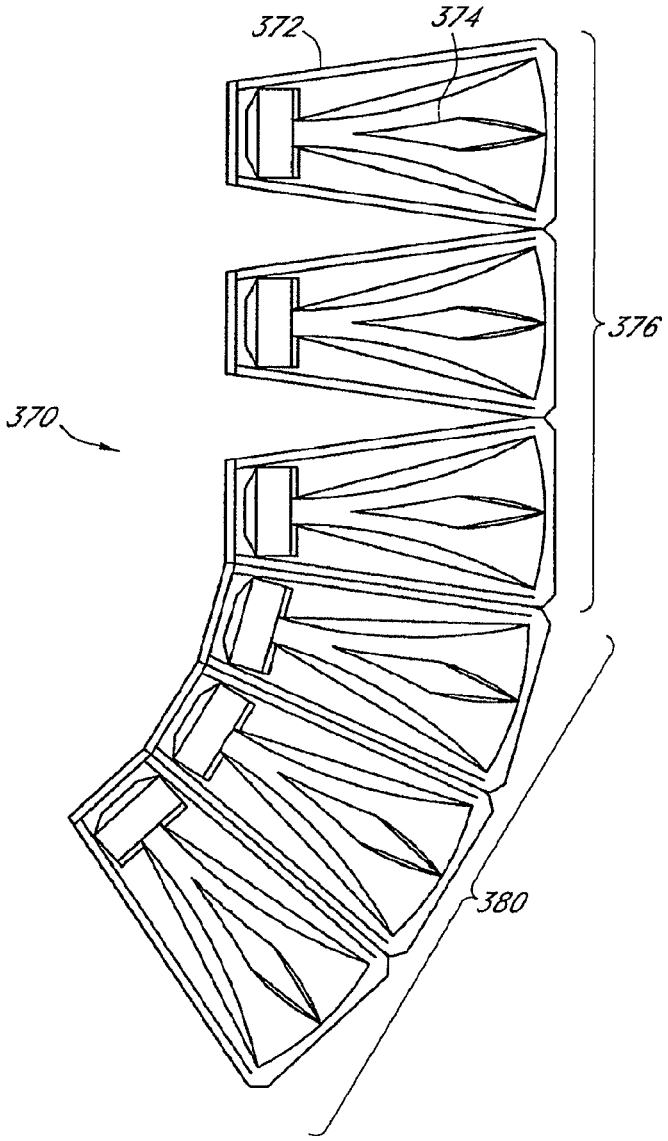

FIGS. 6A-B illustrate some possible methods of using the horn assemblies described above. FIG. 6A illustrates a speaker array 350 comprising a stack 356 of high frequency horn assemblies 364 interposed between two stacks 352, 354 of bass speakers 360. The vertical dimension of the horn assembly 364 may be selected to be similar to the vertical dimension of the bass speakers 360.

In one embodiment of the stack 356 illustrated in FIG. 6A, each of the four high frequency horn assemblies 364 has an actively transmitting area that has a vertical dimension $H_{horn}$ of approximately 9". The array 350 has an overall height $H_{array}$ of approximately 43.9". Thus, the fraction (vertical) of actively transmitting area in such a configuration is approximately 4×9/43.9=0.82, which satisfies the previously described 80% rule.

FIG. 6B illustrates an ensemble 370 of flared horn assemblies 372 arranged in two possible configurations. Each of the horn assembly 372 defines a flared horn cavity, and a plug 374 is positioned therein in a similar manner to that described above in reference to FIG. 5C. The horn assembly 372 has an angled exterior such that its exit end's dimension is greater than its speaker driver end's dimension. As such, the horn assemblies 372 can be arranged in a first exemplary configuration 376 wherein the front faces of the exit apertures are aligned in a same plane. Alternatively, the horn assemblies 372 can be arranged in a second exemplary configuration 380 wherein the angles sides of the adjacent horn assemblies engage each other, such that the front faces of the exit apertures fan out. The first configuration 376 generally offers more directionality of the sound emitted therefrom, and the fanned second configuration 380 offers more coverage, if desired.

Figure 7A:
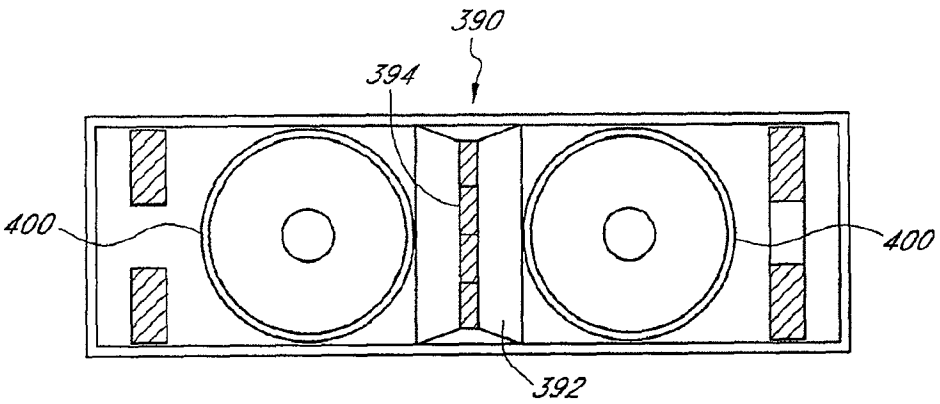
FIGS. 7A and B illustrate one embodiment of the horn assembly having a horizontal flare at the horn exit thereby allowing control of the horizontal coverage of the emitted sound.

FIGS. 7A and B illustrate one possible embodiment of a horn assembly 390 having a horizontal flare 392 attached to a vertically oriented exit apertures 394. The horn assembly 390 without the horizontal flare 392 may be one of the horn assemblies described above. As previously described, the sound emanating from the exit apertures 394 (without the horizontal flare) generally has a cylindrical shaped wavefronts generally having a cross sectional shape of a half circle. Thus, such a cylindrical wave spreads in a range of approximately 180 degrees. While such spreading of the cylindrical wave covers a wide horizontal range, range is reduced because of the wide spreading. By placing the horizontal flare 392 in front of the exit apertures 394, the horizontal spreading of the wavefronts may be controlled in an advantageous manner. For example, the horizontal flare 392 has an opening angle less than 180 degrees, thereby reducing the horizontal dispersion and extending the range of the waves. Thus, it will be appreciated that the opening angle of the horizontal flare 392 may be selected from a range of approximately zero to 180 degrees to control the horizontal coverage and the range as desired.

The horn assembly 390 having the horizontal flare 392 may be used in conjunction with large bass speakers 400, as shown in FIGS. 7A and B. Furthermore, such a combination high frequency horn assembly 390 and the bass speakers 400 may be stacked vertically in a manner similar to that described above in reference to FIG. 6A. Alternatively, the horn assembly 390 may be operated by itself or arrayed with other horn assemblies (with or without the horizontal flares), without being proximate the bass speakers, without departing from the spirit of the invention.

Various embodiments of the horn assembly described herein extend the dimension of the wavefront along the vertical direction. It will be understood that the vertical direction is only one possible preferred direction. The novel concept of increasing the output dimension of the horn assembly along a preferred direction by forming a plurality of apertures along the preferred direction is applicable with any choice of the preferred direction, including the horizontal direction.

Figure 7B:
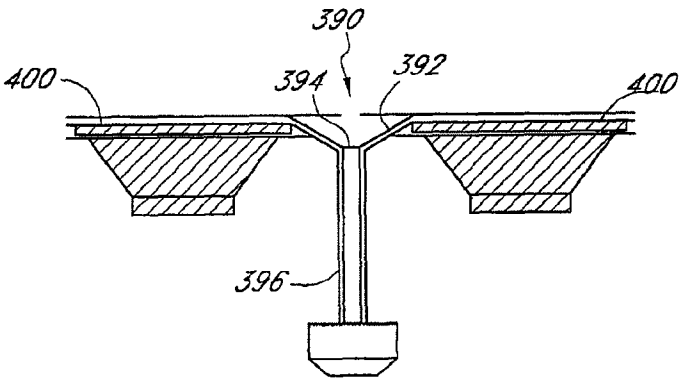

The vertically oriented horn assemblies disclosed herein comprise various plug structures that isolate the plurality of apertures and acoustic paths from each other vertically. These vertically isolated multiple apertures and paths are described above in reference to FIGS. 1A-B, 3, 5A-C, 6A-B, and 7A-B. In one aspect of the invention, the multiple apertures and their corresponding paths being isolated along the preferred direction allows the plugs to be configured in a relatively simple manner. In particular, as exemplified in the side sectional view of one embodiment in FIG. 1A, the plugs may be relatively simple slabs having appropriate side profiles. For example, the plugs 112*a, b* in FIG. 1A may be diamond shaped slabs, with the slab thickness being approximately same as the horizontal width of the multiple apertures thereby vertically isolating them from each other. Such a configuration allows, if desired, the horizontal dimension of the horn portion to be relatively thin, thereby providing more flexibility in design and implementation of the horn assembly. In certain embodiments, such as that shown in FIG. 7B, the horn portion (other than the horizontal flare) of the assembly may be substantially narrower than the horizontal dimension of the driving element at the rear. In such applications, the depth of the horn assembly may be sufficiently large to allow the driving element from interfering with the adjacent bass speakers. Thus, if the horizontal flare is absent in the configuration of FIG. 7B, the two flanking bass speakers may be brought closer together if desired.

Various embodiments of the horn assembly described above utilize one or more plugs to allow advantageous increase in the exit dimension. The plugs and their corresponding horns can be constructed in a variety of ways using any of the acoustic materials. The material may include, by way of example, aluminum, polyvinyl chloride (PVC), glass filled nylon, urethane, or any number of acoustically favorable materials. These possible materials may be formed, by way of example, by machining, sand casting, injection molding, or any number of processes configured to form three dimensional objects. It will be appreciated that the various embodiments of the novel concepts described herein may be formed by one or more, or any combination of the aforementioned fabrication methods from one or more, or any combination of the aforementioned materials without departing from the spirit of the invention.

Although the foregoing description has shown, described and pointed out the fundamental novel features of the invention, it will be understood that various omissions, substitutions, and changes in the form of the detail of the apparatus as illustrated as well as the uses thereof, may be made by those skilled in the art, without departing from the spirit of the invention. Consequently, the scope of the present invention should not be limited to the foregoing discussions, but should be defined by the appended claims.

What is claimed is:

1. A speaker assembly, comprising:

a sound source that produces a sound signal; and a housing having an input aperture and a plurality of output apertures that are distributed substantially along a first direction, wherein the housing is acoustically coupled to the sound source to receive the sound signal at the input aperture, and wherein the housing defines at least three acoustic paths, including at least one central acoustic path and at least one outer acoustic path wherein the outer acoustic path is interposed between the housing and the at least one central acoustic path and wherein the at least three acoustic paths have substantially equal path lengths that link the input aperture to the plurality of output apertures such that the sound signal is divided into a plurality of sound signals that are distributed in the first direction by travelling along the at least three acoustic paths such that the plurality of sound signals emanate from the plurality of output apertures at substantially the same time to combine to form a substantially coherent combined sound signal that is expanded in the first direction.

2. The speaker assembly of claim 1, wherein the first direction is linear.

3. The speaker assembly of claim 1, wherein the first direction is curvilinear.

4. The speaker assembly of claim 1, wherein the first direction is substantially orthogonal to the longitudinal axis of the housing.

5. The speaker assembly of claim 1, wherein the substantially coherent combined sound signal that is expanded in the first direction approximates sound from a segmented line source.

6. The speaker assembly of claim 1, wherein the housing defines the plurality of acoustic paths through use of at least two plugs.

7. The speaker assembly of claim 6, wherein the at least two plugs have a first end biased towards the input aperture and a second end biased towards the output apertures and having a maximum width along the first direction at a location between the first and second ends, such that the first end of a given plug divides an existing path into two acoustic paths and wherein the second end of said given plug divides an existing output aperture into two smaller output apertures.

8. The speaker assembly of claim 7, wherein the housing defines the outermost boundaries of the acoustic paths, such that a width dimension between the outermost boundaries along the first direction increases from a location that is substantially before the maximum width location of the at least two plugs, towards the second end to a location that is substantially beyond the maximum width location of the at least two plugs.

9. A speaker assembly, comprising:

a sound source that produces a sound signal; and a housing having an input aperture and at least three output apertures, wherein the housing is acoustically coupled to the sound source to receive the sound signal at the input aperture, and wherein the housing defines at least three acoustic paths, including at least one central acoustic path and at least one outer acoustic path wherein the outer acoustic path is interposed between the housing and the at least one central acoustic path and wherein the at least three acoustic paths have substantially equal path lengths that link the input aperture to the at least three output apertures such that the sound signal is divided into at least three sound signals that travel along the at least three acoustic paths such that the at least three sound signals emanate from the at least three output apertures at substantially the same time to combine to form a substantially coherent combined sound signal that is expanded in a first direction.

10. The speaker assembly of claim 9, wherein the at least three output apertures are distributed substantially along the first direction.

11. The speaker assembly of claim 9, wherein the first direction is linear.

12. The speaker assembly of claim 9, wherein the first direction is curvilinear.

13. The speaker assembly of claim 9, wherein the first direction is substantially orthogonal to the longitudinal axis of the housing.

14. The speaker assembly of claim 9, wherein the substantially coherent combined sound signal that is expanded in the first direction approximates sound from a segmented line source.

15. The speaker assembly of claim 9, wherein the housing defines the at least three acoustic paths through the use of at least two plugs.

16. The speaker assembly of claim 15, wherein the at least two plugs have a first end biased towards the input aperture and a second end biased towards the output apertures and having a maximum width along the first direction at a location between the first and second ends, such that the first end of a given plug divides an existing path into two acoustic paths and wherein the second end of said given plug divides an existing output aperture into two smaller output apertures.

17. The speaker assembly of claim 16, wherein the housing defines the outermost boundaries of the acoustic paths, such that a width dimension between the outermost boundaries along the first direction increases from a location that is substantially before the maximum width location of the at least two plugs, towards the second end to a location that is substantially beyond the maximum width location of the at least two plugs.

* * * * *